US009121194B2

(12) United States Patent
Chan

(10) Patent No.: US 9,121,194 B2
(45) Date of Patent: Sep. 1, 2015

(54) UTILITY POLE ASSEMBLY

(71) Applicant: Kong Wei Chan, Selangor (MY)

(72) Inventor: Kong Wei Chan, Selangor (MY)

(73) Assignee: DAY BRITE INDUSTRIAL MANUFACTURING SDN, BHD., Selangor (MY)

( * ) Notice: Subject to any disclaimer, the term of this patent is extended or adjusted under 35 U.S.C. 154(b) by 0 days.

(21) Appl. No.: 14/391,527

(22) PCT Filed: Apr. 3, 2013

(86) PCT No.: PCT/MY2013/000073

§ 371 (c)(1),
(2) Date: Oct. 9, 2014

(87) PCT Pub. No.: WO2013/154416

PCT Pub. Date: Oct. 17, 2013

(65) Prior Publication Data

US 2015/0089901 A1 Apr. 2, 2015

(30) Foreign Application Priority Data

Apr. 10, 2012 (MY) ..... 20122700178

(51) Int. Cl.

| | |
|---|---|
| ***E04H 12/34*** | (2006.01) |
| ***E04H 12/08*** | (2006.01) |
| ***E04H 12/22*** | (2006.01) |
| ***E04H 12/00*** | (2006.01) |

(52) U.S. Cl.

CPC ..... *E04H 12/342* (2013.01); *E04H 12/003* (2013.01); *E04H 12/085* (2013.01); *E04H 12/2238* (2013.01)

(58) Field of Classification Search

CPC ... E04H 12/185; E04H 12/22; E04H 12/2269; E04H 12/342; E04H 12/2223; E04H 12/08; E04H 12/24; E04C 3/30

USPC ..... 52/40, 843, 845, 848–850, 855, 651.01, 52/651.07; 403/292, 336

See application file for complete search history.

(56) References Cited

U.S. PATENT DOCUMENTS

| | | | | |
|---|---|---|---|---|
| 1,445,938 A * | 2/1923 | Farrington | ..... | 52/295 |
| 3,936,206 A | 2/1976 | Meisberger | | |
| 5,175,971 A * | 1/1993 | McCombs | ..... | 52/843 |
| 5,864,998 A * | 2/1999 | Loomer | ..... | 52/271 |

(Continued)

FOREIGN PATENT DOCUMENTS

| | | |
|---|---|---|
| AU | 741307 | 12/1998 |
| DE | 202005010139 | 11/2005 |

(Continued)

OTHER PUBLICATIONS

English Abstract of DE 202005010139.

(Continued)

*Primary Examiner* — Beth Stephan

(74) *Attorney, Agent, or Firm* — Preston Smirman; Smirman IP Law, PLLC

(57) ABSTRACT

An article of elongate metal piece (101*a*) comprising a retaining track (102*a*) and a shaft (103*a*) at its respective long edges, wherein multiple pieces (101*a*) of the identical articles are arranged in a side-by-side fashion to assemble a pole section with two contiguous arranged metal pieces (101*a*) interlocked by engaging the shaft (103*a*) of one metal piece to the retaining track (102*a*) of another adjacent metal piece.

19 Claims, 13 Drawing Sheets

(56) References Cited

U.S. PATENT DOCUMENTS

| | | | | |
|---|---|---|---|---|
| 5,979,119 | A * | 11/1999 | Trafton | 52/40 |
| 6,286,281 | B1 * | 9/2001 | Johnson | 52/592.1 |
| 6,453,635 | B1 * | 9/2002 | Turner | 52/848 |
| 6,467,233 | B1 * | 10/2002 | Maliszewski et al. | 52/831 |
| 6,957,518 | B1 * | 10/2005 | Koch, Jr. | 52/849 |
| 7,464,512 | B1 * | 12/2008 | Perina | 52/651.01 |
| 8,082,719 | B2 * | 12/2011 | Bagepalli | 52/849 |
| 2003/0196393 | A1 * | 10/2003 | Bowman et al. | 52/295 |
| 2005/0271467 | A1 * | 12/2005 | Ong | 403/359.1 |
| 2006/0236648 | A1 * | 10/2006 | Grundman et al. | 52/726.4 |
| 2008/0041009 | A1 * | 2/2008 | Cairo et al. | 52/651.07 |
| 2008/0250752 | A1 * | 10/2008 | Bowman et al. | 52/848 |
| 2010/0071275 | A1 * | 3/2010 | Mathai et al. | 52/40 |
| 2010/0205875 | A1 | 8/2010 | Rawson-Harris | |
| 2010/0205901 | A1 * | 8/2010 | Petta | 52/831 |
| 2011/0239586 | A1 * | 10/2011 | Stiesdal | 52/854 |
| 2011/0283652 | A1 * | 11/2011 | Haridasu et al. | 52/651.01 |
| 2012/0137622 | A1 * | 6/2012 | Patterson et al. | 52/651.01 |

FOREIGN PATENT DOCUMENTS

| | | |
|---|---|---|
| FR | 2948399 | 1/2011 |
| WO | 2004038134 | 5/2004 |

OTHER PUBLICATIONS

English Abstract of FR 2948399.

* cited by examiner

UTILITY POLE ASSEMBLY

CROSS-REFERENCE TO RELATED APPLICATION

The instant application is a national phase of PCT International Patent Application Serial No. PCT/MY2013/000073, filed Apr. 3, 2013, and claims priority to Malaysian Patent Application Serial No. PI 2012700178, filed Apr. 10, 2012, the entire specifications of both of which are expressly incorporated herein by reference.

FIELD OF INVENTION

The present invention relates to a utility pole assembly or system. Particularly, the disclosed utility pole system can be assembled from a plurality of pre-fabricated pieces which promote convenient storage and delivery of the disclosed system the targeted site for in situ construction.

BACKGROUND OF THE INVENTION

Utility pole has been used particularly in the field of power transmission and telecommunication for decades. Improvement is made to enhance usability of the utility pole along the years. Specifically, utility poles of recent days generally carry mountable platform to facilitate attachment of various fixtures which are required for different activities. For example, streetlight, signs, security cameras, traffic signals and the like are the common articles mounted onto the utility poles to perform the designed tasks. Description on fixture mounting mechanisms for utility poles can be respectively found in disclosure of Australian patent application no. 199870041, United States patent publication no. 2010205875, and International patent publication no. WO2004038134. To reduce unnecessary weight and material used in the manufacturing of the pole, the center of the pole is fabricated to be hollow which, meanwhile, serves as the ducting channel to store switchgears, circuit board, cables and the like within the pole protecting these vulnerable components from being sabotaged or damaged by external factors. Apart from that, utility poles are preferably fabricated into two or three shorter sections to ease the transportation and manufacturing process. These shorter sections are then delivered to the site to be assembled together and erected to carry out its designated function. Utility pole featuring such design is disclosed in U.S. Pat. No. 3,936,206 which particularly describes joining of the pole section employing a slip joint concept. Yet, manufacturing poles in various shorter sections only solve parts of the problem as the hollow contained within these shorter sections inevitably uses up unwanted transportation and storage capacity. Additional transportation and storage cost are incurred. Hence, utility pole capable of resolving the above mentioned shortcoming are highly appreciated.

SUMMARY OF THE INVENTION

The present invention aims to provide a utility pole assembly or system. Specifically, the disclosed utility pole carries pre-fabricated mounting mechanism facilitating attachment of various fixtures to perform the needed tasks.

Another object of the disclosed invention is to offer a utility pole assembly capable of being transported and stored using relatively lower capacity comparing to those conventional pole system. Specifically, at least one of the pole sections in the disclosed invention are assembled from a plurality of substantially identical metal pieces without having any hollow space resided inside thus facilitating storage and transportation of the disclosed pole system.

Further object of the present invention is to offer a simplified interlocking interface for joining the shorter pole section to form a complete utility pole. Particularly, the mounting mechanism for attachment of the utility fixture is employed as well in the present invention for interlocking the different pole section. The combined features significant simplify both manufacturing and assembling process of the described pole system.

Further object of the present invention is to provide utility pole enclosing a service chamber with enhanced security feature which capable of preventing unauthorized access. Conventional reclosable door of the service chamber mounted onto the pole by welding that the hinge carrying out movement of the reclosable door is exposed at the exterior of the pole. It is not uncommon that unauthorized access of the service chamber is achieved by damaging the welded hinge with brutal force. The disclosed invention addresses the stated problem through shielding the hinge within the chamber through a slide-in interlocking engagement.

At least one of the preceding objects is met, in whole or in part, by the present invention, in which one of the embodiments of the present invention is a utility pole comprising a lower pole section; an upper pole section; and a fastening plate mounted at one end of the lower and upper pole sections to join both sections together; wherein the lower pole section is composed of a plurality of identical elongate metal pieces that each carries a retaining track and a shaft at its respective long edges characterized in that the lower pole section is assembled through arranging the metal pieces in a side-by-side fashion at the long edges to form a substantial tubular formation and two contiguous arranged metal pieces are interlocked by engaging the shaft of one metal piece to the retaining track of the adjacent metal piece.

In another aspect, at least one of the metal piece has the shaft defined a internal first locking groove accessible by way of a first top and bottom openings and the fastening plate possesses corresponding first through hole that plugging a bolt via the first top opening into the first locking groove and the first through hole interlocks the metal piece and the fastening plate.

In another aspect, at least one of the metal piece defining a longitudinal second locking groove accessible by way of a second top and bottom openings and the fastening plate possesses corresponding second aperture that plugging a bolt via the second top opening into the second locking groove and the second through hole interlocks the metal piece and the fastening plate.

In another aspect, the upper pole section has at least one longitudinal third locking groove accessible by way of a third bottom opening and the fastening plate possesses corresponding third through hole that plugging a bolt via the third bottom opening into the third locking groove and the third through hole interlocks the upper pole section and the fastening plate.

In another aspect, the fastening plate has a first male protruding configuration at the bottom and the lower pole section has a first female receptive configuration that mating of the first male protruding configuration and first female receptive configuration interlock the lower pole section to the fastening plate.

In another aspect, the fastening plate has a second male protruding configuration at the top and the upper pole section has a second female receptive configuration that mating of the second male protruding configuration and second female receptive configuration interlock the upper pole section to the fastening plate.

Preferably, in another embodiment, the upper pole section has the exterior surface fabricated with one or more track for releasably attachment of one or more fixture.

Preferably, in another embodiment, the lower pole section has the exterior surface fabricated with one or more track for releasably attachment of one or more fixture.

Preferably, in another embodiment, the lower pole has the exterior surface fabricated with one or more track for releasably attachment of one or more fixture and the track is the first female receptive configuration.

Preferably, in another embodiment, the upper pole has the exterior surface fabricated with one or more track for releasably attachment of one or more fixture.

Preferably, in another embodiment, the upper pole has the exterior surface fabricated with one or more track for releasably attachment of one or more fixture and the track is the second female receptive configuration.

In another aspect, the disclosed invention includes as well a base plate, for anchoring onto the ground, having a horizontally upraised projection of circular formation located substantially at the center of the base plate that side surface of the projection has a plurality of indentation to neatly fit in part of the retaining track of the metal pieces (101) of another end of the lower pole section.

In another aspect, the disclosed invention includes also a base plate, for anchoring onto the ground, having a locking aperture corresponded to the first bottom opening that plugging a bolt via the first bottom opening into the first passage and the locking aperture interlocks the metal piece and the base plate.

Still, in another embodiment, the disclosed utility pole comprising a lower pole section; an middle pole section; and a primary fastening plate mounted at one end of the lower and middle pole sections to join both sections together; wherein at least one of the pole section is composed of a plurality of identical elongate metal pieces that each carries a retaining track and a shaft at its respective long edges characterized in that the pole section is assembled through arranging the metal pieces in a side-by-side fashion at the long edges to form a substantial tubular formation and two contiguous arranged metal pieces are interlocked by engaging the shaft of one metal piece to the retaining track of the adjacent metal piece. Accordingly, the disclosed pole may further comprise an upper pole section joined to another end of the middle pole section through a secondary fastening plate.

Still, in another embodiment, the present invention is in the form of an article of elongate metal piece comprising a retaining track and a shaft at its respective long edges, wherein multiple pieces of the identical articles are arranged in a side-by-side fashion to assemble a pole section with two contiguous arranged metal pieces interlocked by engaging the shaft of one metal piece to the retaining track of another adjacent metal piece. Preferably, the shafts defines an internal first locking groove accessible by way of a first top and a first bottom openings that a fastening plate having corresponding first through hole is interlockable to the metal piece by plugging a bolt via the first top opening into the first locking groove.

Further, the disclosed invention also has an embodiment involving a utility pole comprising a lower pole section; an upper pole section; a fastening plate mounted at one end of the lower and upper pole sections to join both sections together; and a service chamber defined within the lower pole section accessible by way of a reclosable side door fabricated on the lower pole section; characterized in that the lower pole section comprises an elongate frame structure, which is outwardly curved at the horizontal axis, carrying a first and a second interlocking profiles at its respective vertical edges with a gap presented in between the vertical edges; and a plurality elongate parts having a third and a fourth interlocking profiles, at its respective vertical edges, which allow the elongate parts to slidably and stackably engage onto the first and second interlocking profiles of the frame structure to substantially shield the gap, wherein one of the elongate parts serving as the side door is free of one of the interlocking profiles to be pivotally moveable in relative to the frame structure in between an open position to provide access to the service chamber and a close position to substantially shield the gap. Preferably, the utility pole further comprises a locking means mounted on the lower pole section to secure the side door onto the frame structure.

DETAILED DESCRIPTION OF THE INVENTION

One skilled in the art will readily appreciate that the present invention is well adapted to carry out the objects and obtain the ends and advantages mentioned, as well as those inherent therein. The embodiment describes herein is not intended as limitations on the scope of the invention.

The directional terms such as "top", "bottom", "side", "vertical", "horizontal", "central" and so on used throughout herein the specification generally refer to the relative direction of the present invention while the disclosed invention is in use.

Likewise, the terms "lower", "middle" or "upper" used in the disclosed specification solely refer to relative position of different sections at the vertical axis when the present invention is in use without imposing any further limitations. For example, another pole section may be located at position lower than the lower pole and vice versa for the upper pole.

The present invention discloses a utility pole (100) comprises a lower pole section (110); an upper pole section (130); and a fastening plate (160*a*) mounted at one end of the lower pole section (110) and upper pole section (130) to join both sections together; wherein the lower pole section (110) is composed of a plurality of identical elongate metal pieces (101*a*), as shown in FIGS. 1 to 4, that each carries a retaining track (102*a*) and a shaft (103*a*) at its respective long edges characterized in that the lower pole section (110) is assembled through arranging the metal pieces (101*a*) in a side-by-side fashion at the long edges to form a substantial tubular formation and two contiguous arranged metal pieces (101*a*) are interlocked by engaging the shaft (103*a*) of one metal piece to the retaining track (102*a*) of the adjacent metal piece.

Figure 1:
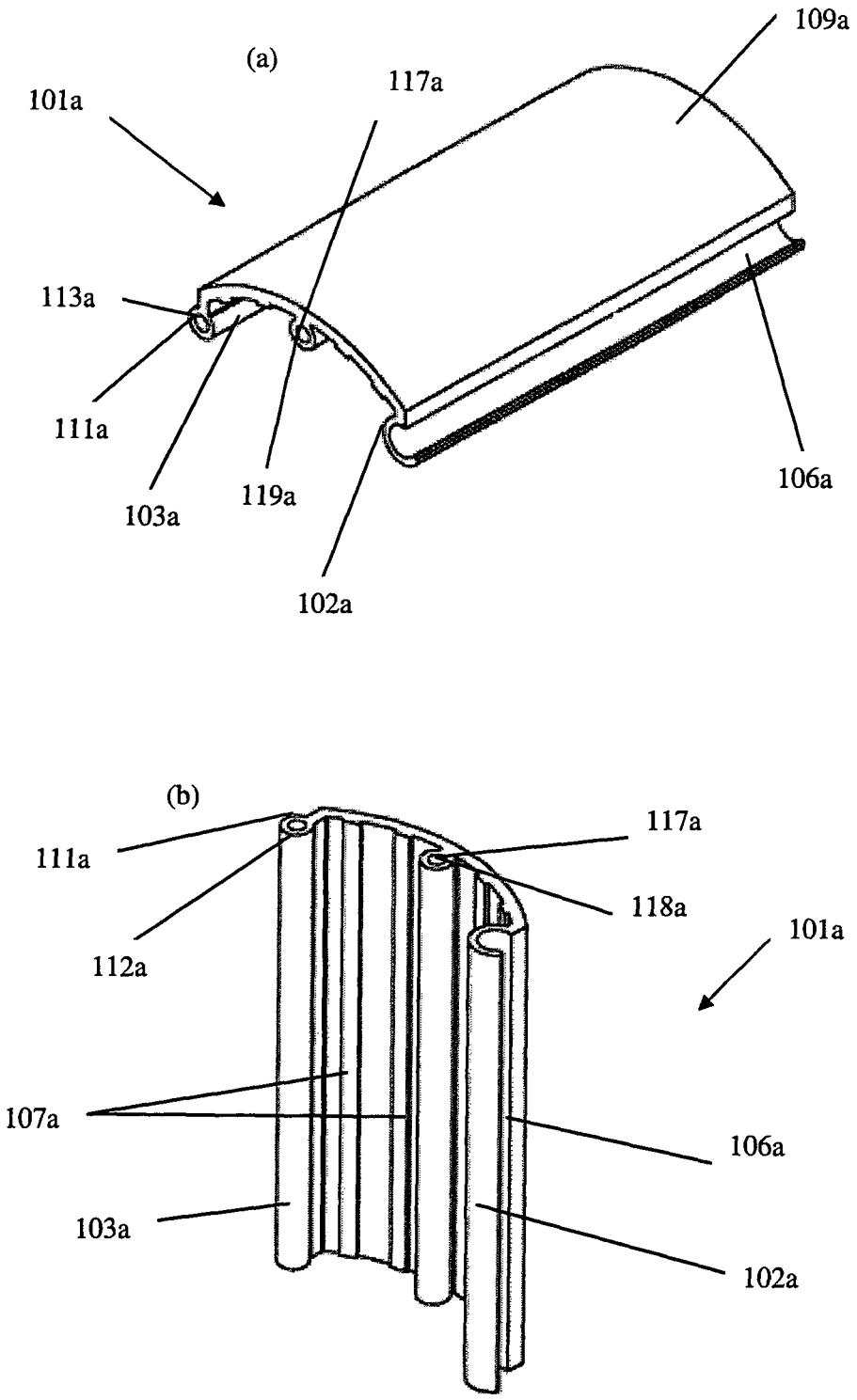
FIG. 1 shows perspective (a) front view and (b) back view of one embodiment of the article to be assembled to form a pole section.

Illustrated in FIG. 1 is one embodiment of the elongate metal piece (101*a*). The metal piece (101*a*) is substantially flat piece besides being outwardly curved at the longitudinal axis to allow tubular formation of the pole section upon assembly of the identical metal pieces (101*a*). The metal piece (101*a*) carries a rather smooth exterior surface (109*a*) while the inner surface (108*a*) is fabricated with a plurality of longitudinally extending ribs (107*a*). Nevertheless, the longitudinal ribs (107*a*) are fabricated at the exterior surface (109*a*) or both surface in one embodiment. Presence of the ribs (107*a*) reinforces the mechanical integrity of each single metal piece rendering these pieces (101*a*) capable of sustaining greater external impact or force without rupture or broken. As above mentioned, the two long edges at the side of the metal piece (101*a*), respectively, have the shaft (103*a*) and the retaining track (102*a*).

Figure 2:
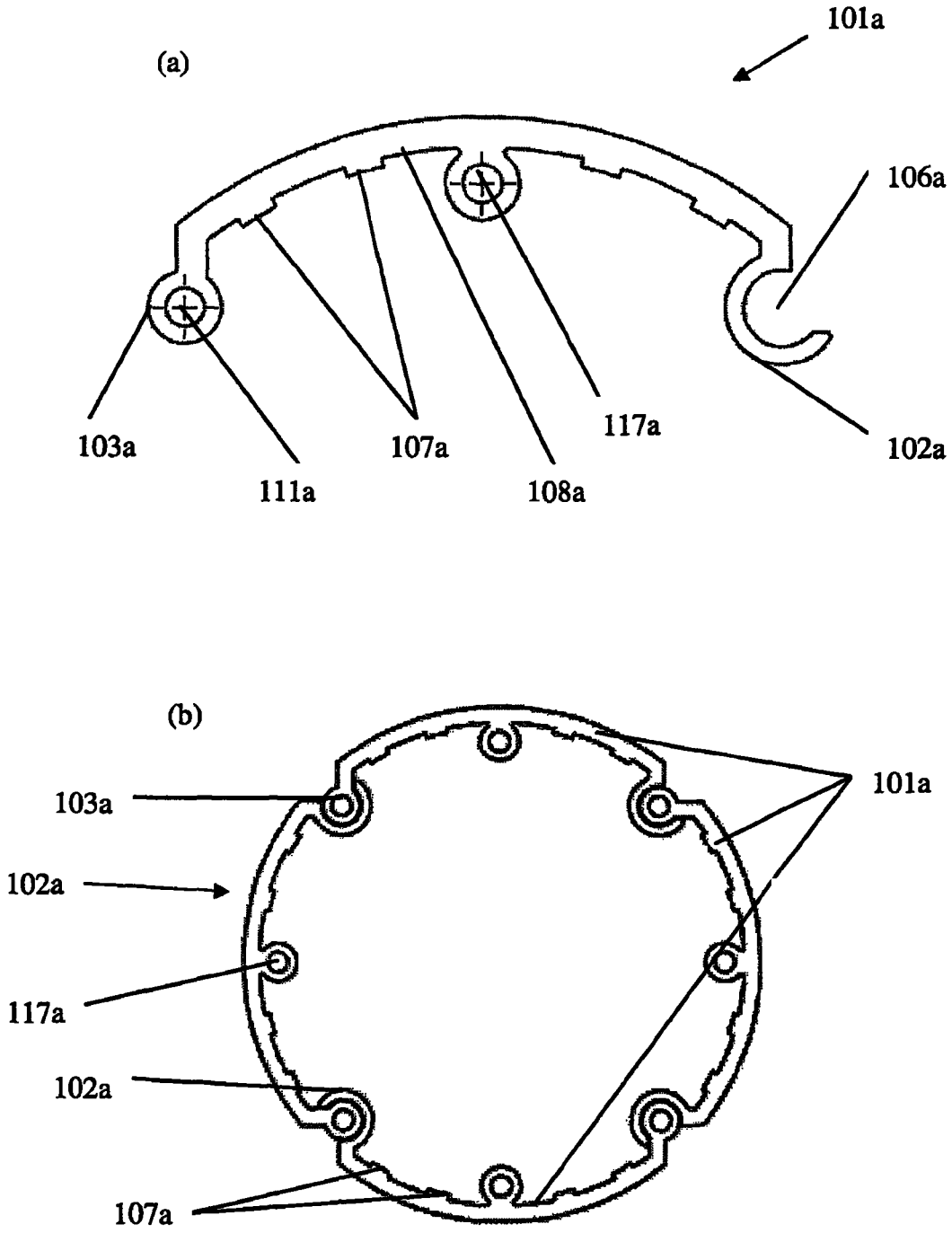
FIG. 2 shows top view of (a) a single article and (b) a plurality of joined articles shown in FIG. 1.

The shaft (103*a*) in the preferred embodiment is a rod-like structure attached to one edge of the metal piece that the shaft (103*a*) has a diameter greater than the average thickness of the metal piece (101*a*). Shown in FIGS. 1 and 2, the shaft (103*a*) is a extending continuously as a single structure. Yet, in other embodiment, the shaft (103*a*) is fabricated from multiple parallel shorter section with a gap spaced in between two contiguous sections. Particularly, the retaining track (102*a*) is a trough-like structure with C-shaped cross-section as shown in FIG. 2*a* that a longitudinal groove is contained within the retaining track (102*a*) with a corresponding longitudinal side opening (106*a*). Shaft (103*a*) of an adjacent metal piece can be slid into the groove within the retaining track (102*a*) via the side opening (106*a*) and the groove adapts to accommodate shaft (103*a*). Particularly, the side opening (106*a*) has a width smaller than the diameter of the shaft (103*a*) to avoid disengagement of the shaft (103*a*) from the side opening once the metal pieces (101*a*) are interlocked. The retaining track (102*a*) and the shaft (103*a*) of the metal piece (101*a*), in the embodiment of FIGS. 1 and 2, are substantially in orthogonal positions to one another in relative to the center axis of the pole section. Having metal piece (101*a*) prepared in this embodiment, formation of the pole section requires engagement of four different copies of the metal pieces (101*a*). Preferably, the metal piece (101*a*) of this embodiment is employed in the assembly, but not necessary, of the lower pole section (110).

Figure 3:
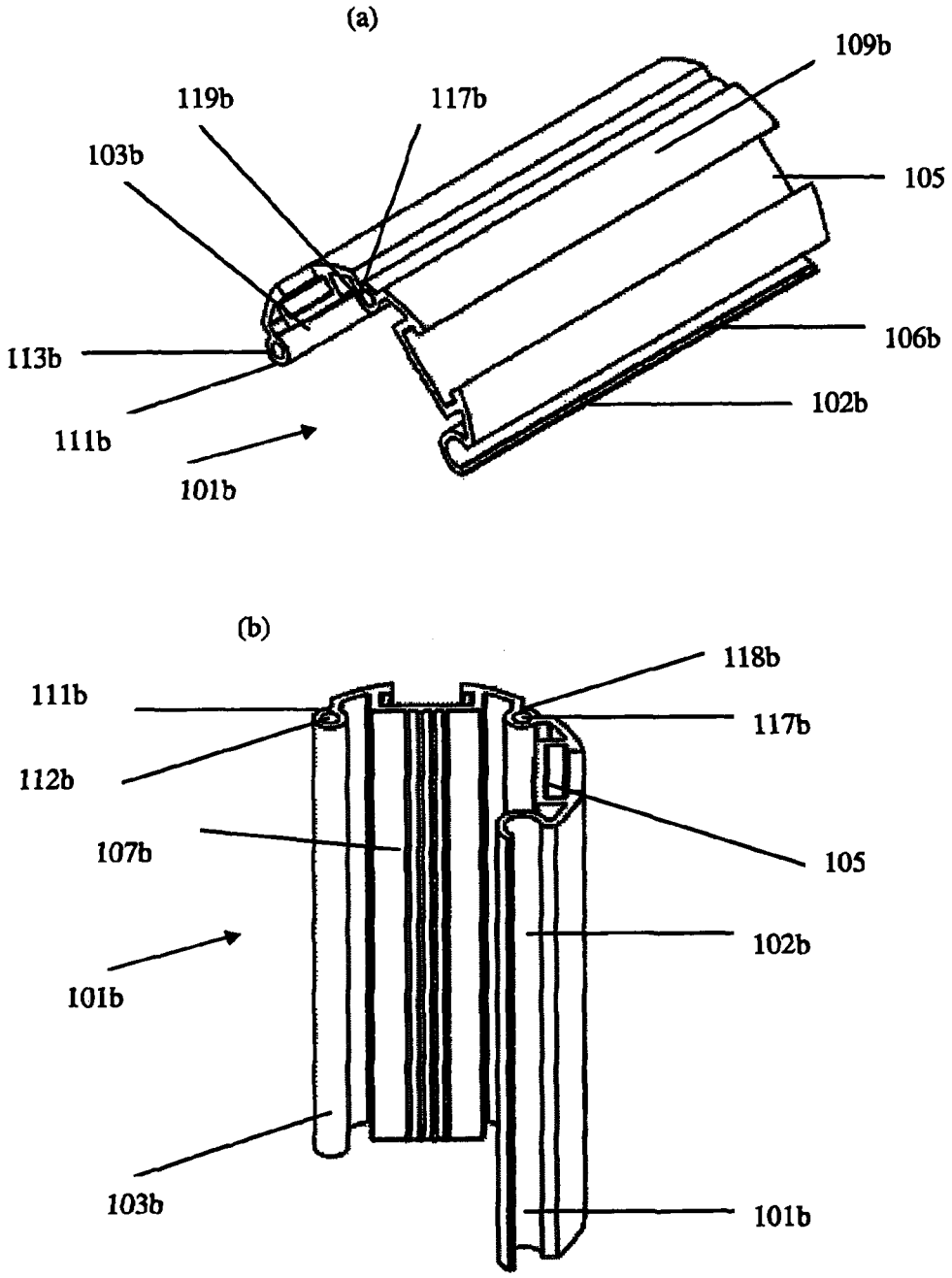
FIG. 3 shows perspective (a) front view and (b) back view of one embodiment of the article to be assembled to form a pole section.
Figure 4:
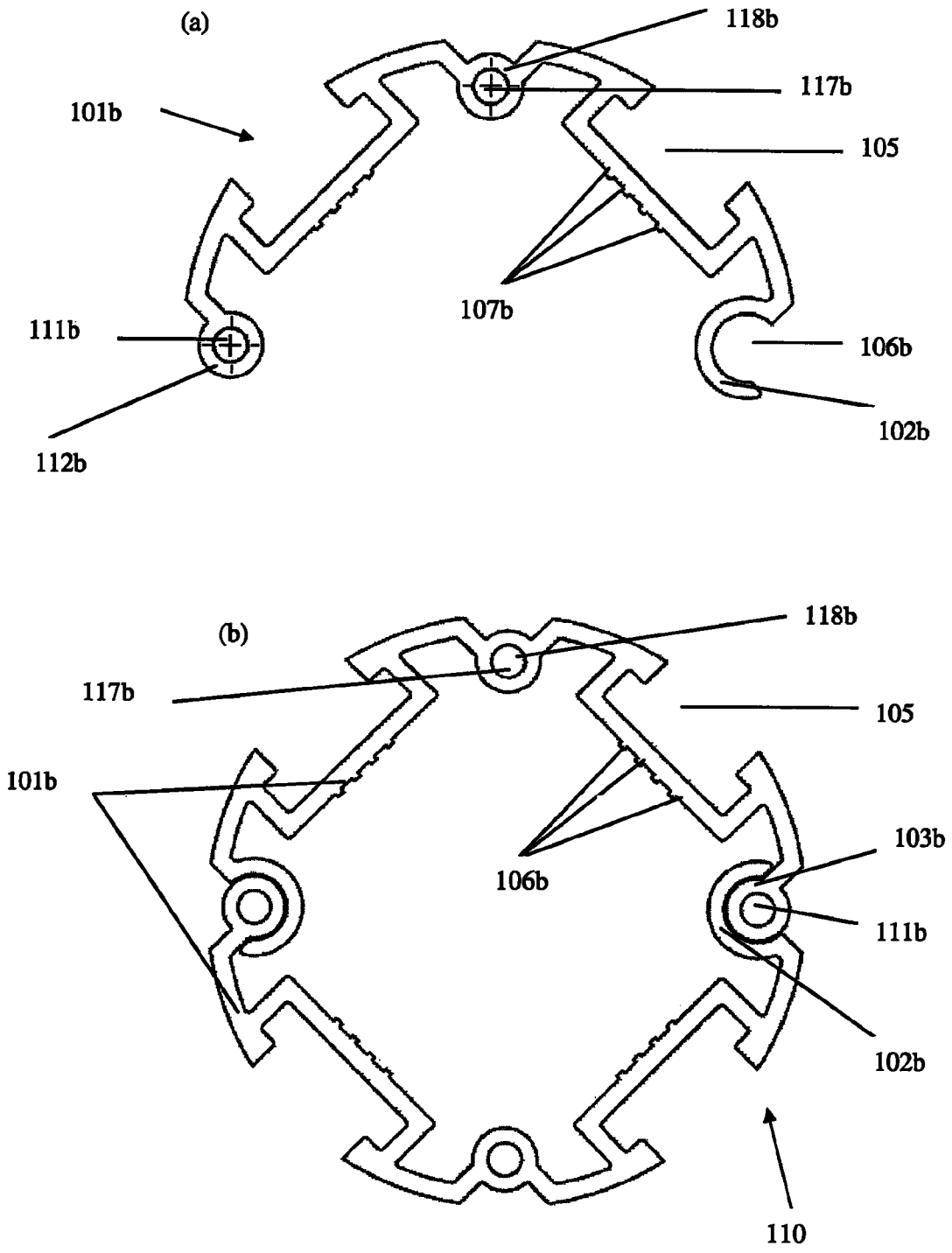
FIG. 4 shows top view of (a) a single article and (b) a plurality of joined articles shown in FIG. 2.

Referring now to FIGS. 3 and 4, another embodiment of the metal piece (101*b*) is shown. In contrast to the above embodiment, the metal piece (101*b*) of this embodiment has the shaft (103*b*) and the retaining track (102*b*) together with the center axis of the pole section collectively form a straight line or there exists 180° between the shaft (103*b*) and the retaining track (102*b*) in relative to the center axis of the pole section. The pole section can be assembled by joining only two identical metal pieces (101*b*) of such embodiment together. Further, retaining track (102*b*) defining a groove with side opening (106*b*), longitudinally extending ribs (107*b*) are fabricated on the metal piece of this embodiment alike the above described embodiment. Preferably, the exterior surface (109*b*) of the metal pieces (101*b*) is fabricated with track (105) for releasably attachment of one or more fixture.

Specifically, track (105) carries a profile or groove in the cross-sectional inverted T-shape extending from one short edge to another short edge of the metal piece (101*b*). The inverted T-shaped groove is an indented area with the wider portion of the inverted T-shaped groove resides closer to the center axis of the pole section and serves to receive part of the fixture with a compatible profile to slide in from the top or bottom of the metal piece (101*b*). The narrow portion is formed by having a pair of opposite protrusion slightly raised from the upper fringe of the indented area to provide an opening allowing the rest of the fixture extended out to carry out the designated function. Moreover, the narrow portion of smaller size also prevents disengagement of the fixture thereof apart from the top or bottom of the metal piece (101*b*). Likewise, the lower pole section (110) derived from the metal pieces (101*b*) also has the exterior surface (109*b*) fabricated, with one or more similar track for releasably attachment of one or more fixture. It is important to be noted herein that the metal piece (101*b*) of such features can be used to produce the upper pole in other embodiments.

Figure 9:
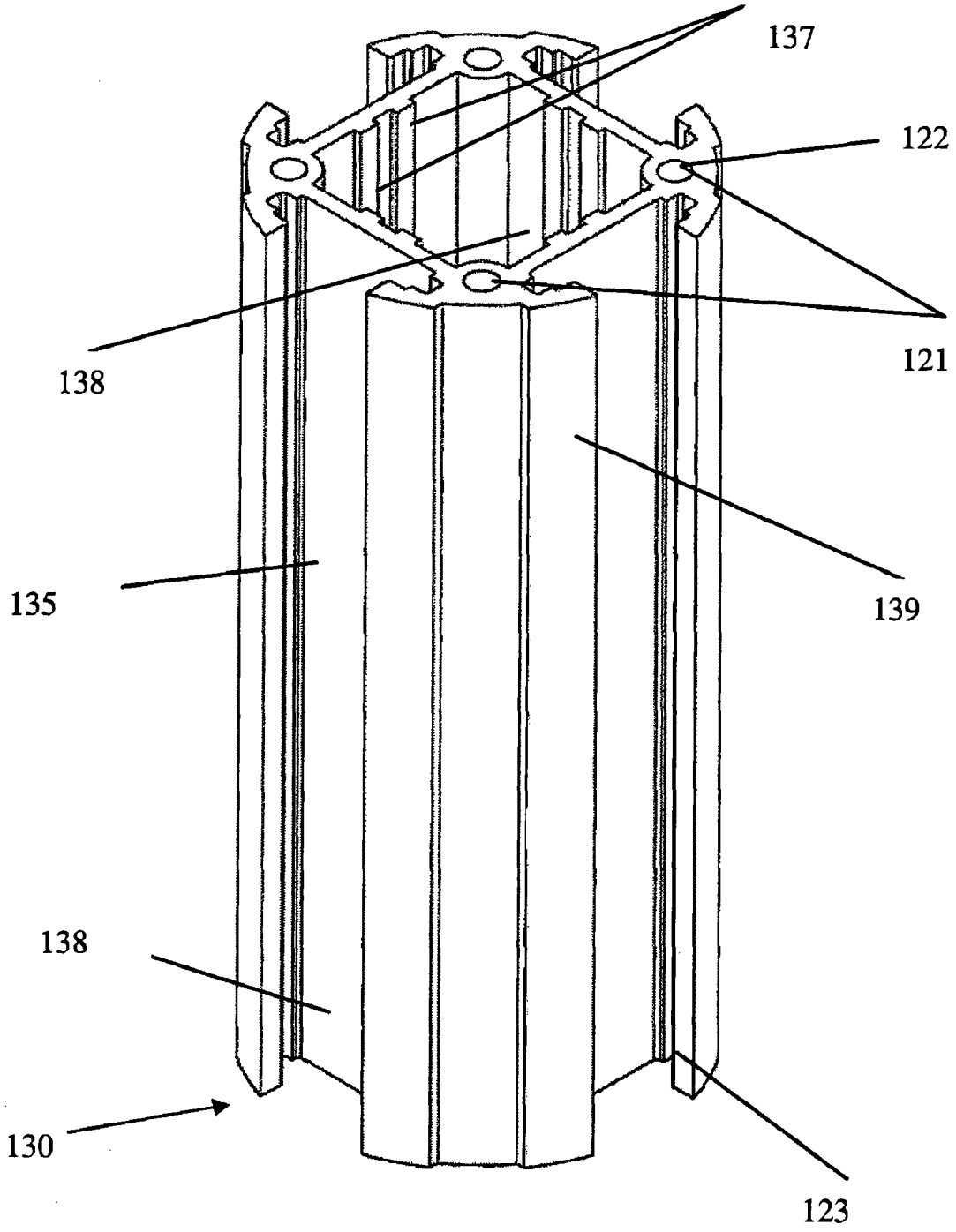
FIG. 9 shows perspective view of one embodiment of the upper pole section (130) fabricated as a single unit.

According to another embodiment of the present invention, the upper pole section (130) can adapt the formation shown in FIG. 9 which is a single piece of structure with the exterior surface (139) fabricated with one or more track (135) for releasably attachment of one or more fixture. Specifically, the upper pole section (130) is an elongate square tube having lateral expansion longitudinally formed at its four corners to define the track (135) in between two adjacent corners for mounting of the fixture. The track (135) on the upper pole section (130) is carved to be similar to the track (105) available in the lower pole section (110) to simplify moving of different fixtures in both upper pole section (130) and lower pole section (110) accord with the condition. The track (135) at the upper pole section (130) is a profile or groove in the cross-sectional inverted T-shape extending from one short edge to another short edge. The inverted T-shaped groove is an indented area with the wider portion of the inverted T-shaped groove resides closer to the center axis of the upper pole section (130) and serves to receive part of the fixture with a compatible profile to slide in from the top or bottom of the upper pole section (130). In general, the upper pole section (130) has the exterior surface (139) fabricated with one or more track for releasably attachment of one or more fixture. The inner surface (138) of the square tube bears vertically extending rib (137) to reinforce the mechanical integrity of the overall upper pole section (130).

Figure 8:
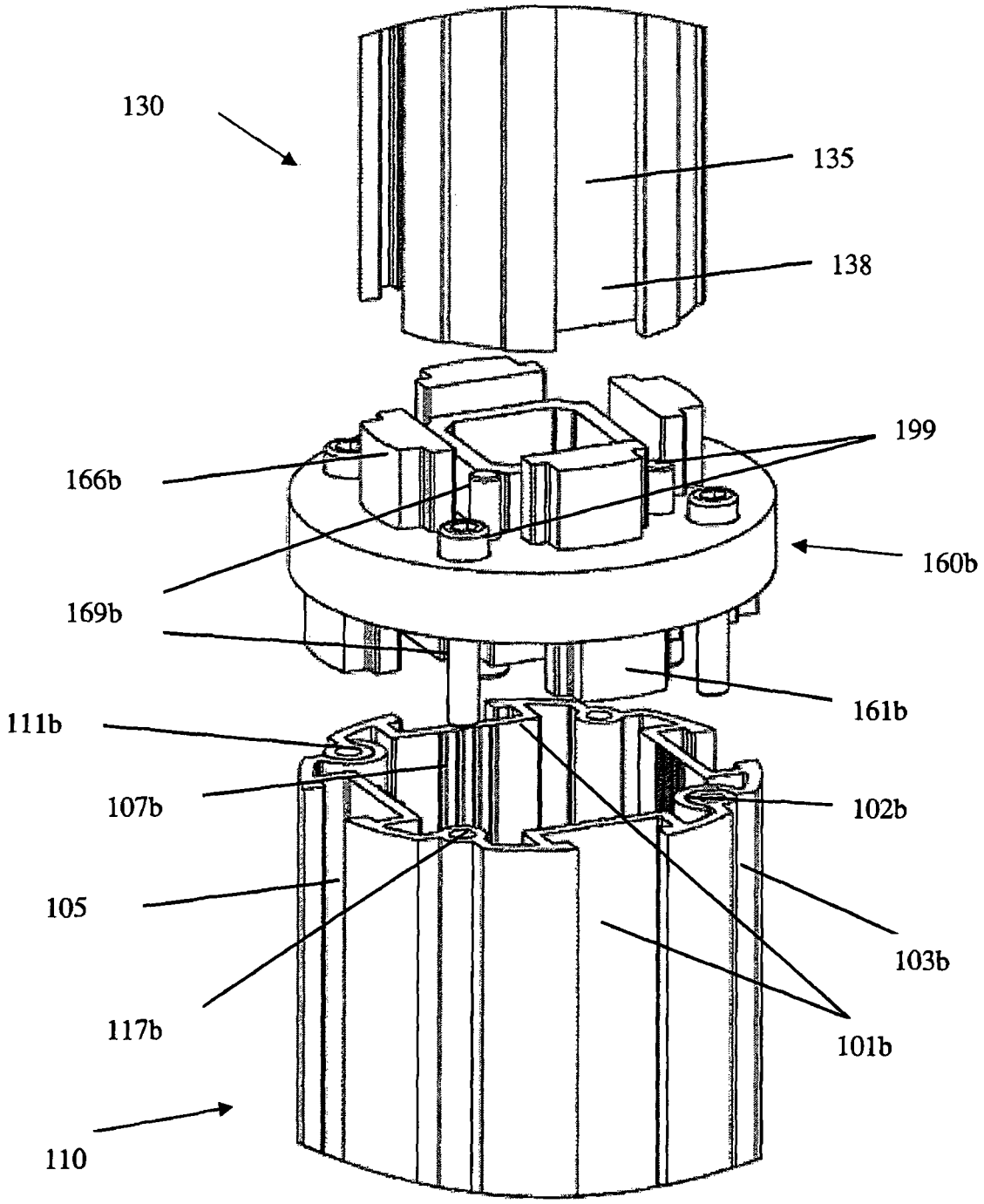
FIG. 8 illustrate joining of the upper pole section (130) and lower pole section (110) through the fastening plate (160*b*) shown in FIG. 7.

Preferably, at least one of the metal piece (101*a*) has the shaft (103*a*) defined an internal first locking groove (111), as in FIGS. 1 to 4, accessible by way of a first top (112) and bottom openings (113) and the fastening plate (160*a*) possesses corresponding first through hole (116) that plugging a bolt via the first top opening (112) into the first locking groove (111) and the first through hole (116) interlocks the metal piece (101*a*) and the fastening plate (160*a*) as further illustrated in FIG. 8. Additionally, the first locking groove (111) available in the shaft (103*a*) is pre-fabricated with inner threads to secure the bolt and the like bearing the compatible marking to facilitate the interlocking of the fastening plate (160*a*) to the pole section. Further, at least one of the metal piece (101*a*) defining a longitudinal second locking groove (117), as in FIGS. 1 to 4, accessible by way of a second top (118) and bottom openings (119) and the fastening plate (160*a*) possesses corresponding second through hole (114) that plugging a bolt (199) via the second top opening (118) into the second locking groove (117) and the second through hole (114) interlocks the metal piece (101*a*) and the fastening plate (160*a*). More particularly, the metal pieces (101*a*) or the lower pole section (110) derived thereof position the second locking groove (117) in between the two long edges to further strengthen the interlocking of the lower pole section (110) and the fastening plate (160*a*). The second locking groove (117) preferably possesses similar size of the first locking groove (111) but not necessary. The second locking groove (117) shall carry threaded inner surface to secure the bolt (199) and the like having the compatible marking as well. To fasten the upper pole section (130) and the lower pole section (110) through the fastening plate (160*a*), the upper pole section (130) has at least one longitudinal third locking groove (121) accessible by way of a third bottom opening (123) and the fastening plate (160*a*) possesses corresponding third through hole (126) that plugging a bolt (199) via the third bottom opening (123) into the third locking groove (121) and the third through hole (126) interlocks the upper pole section (130) and the fastening plate (160*a*). Shown in FIG. 9, there are four different third locking grooves (121) located at each individual corner of the square tube. Rather engaging with the fastening plate (160*a*) through the top opening (112 or 118) like the lower pole section (110), the bolt (199) is inserted into the third locking groove (121) from the bottom opening (123). Nonetheless, the top opening (122) found on the third locking groove (121) permits extra fastening plate (160*a*) and pole section to attach on top of the upper pole section (130).

Figure 5:
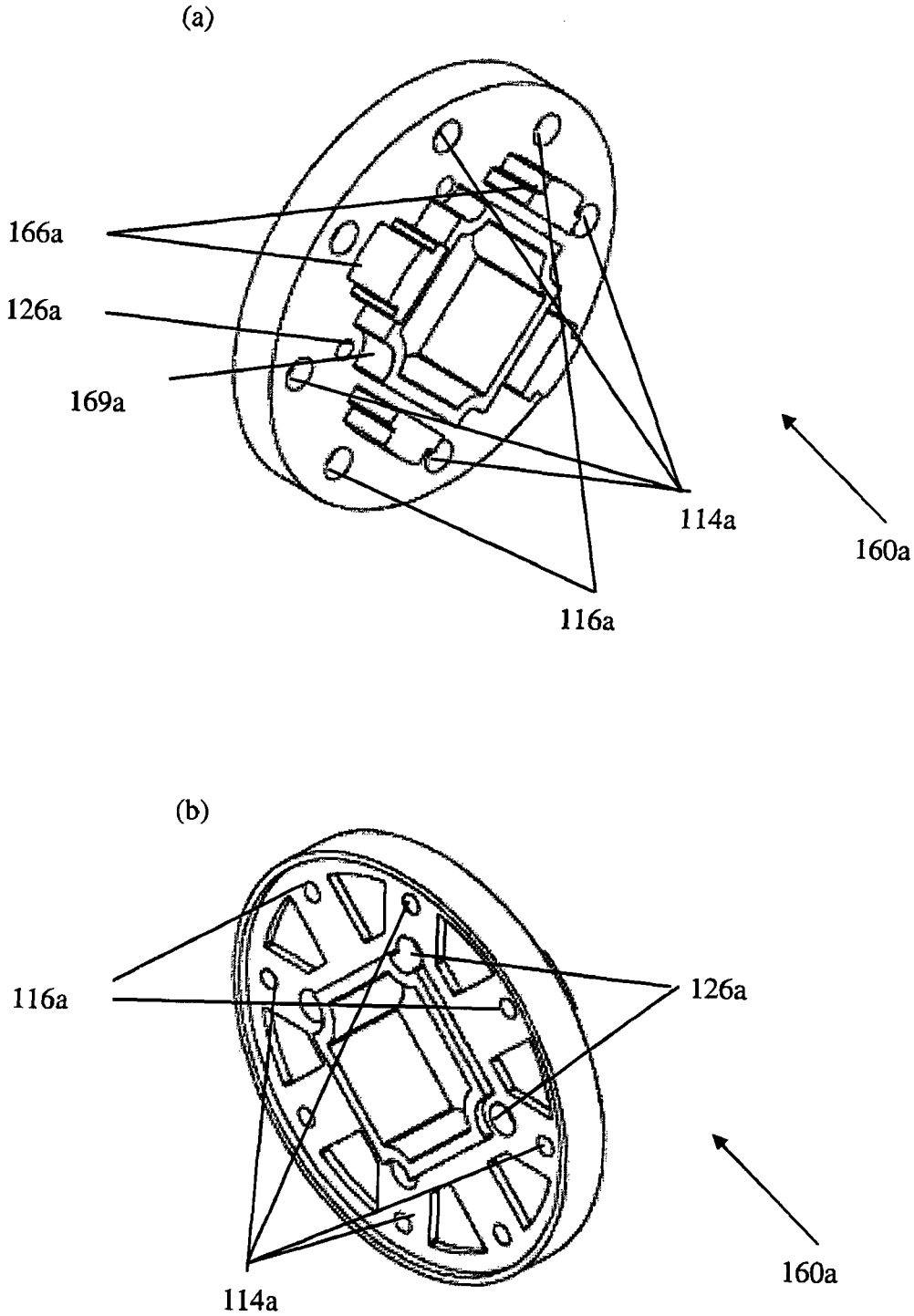
FIG. 5 shows perspective (a) front and (b) back view of one embodiment of the fastening plate (160*a*) for joining the lower pole section (110) and upper pole section (130)
Figure 6:
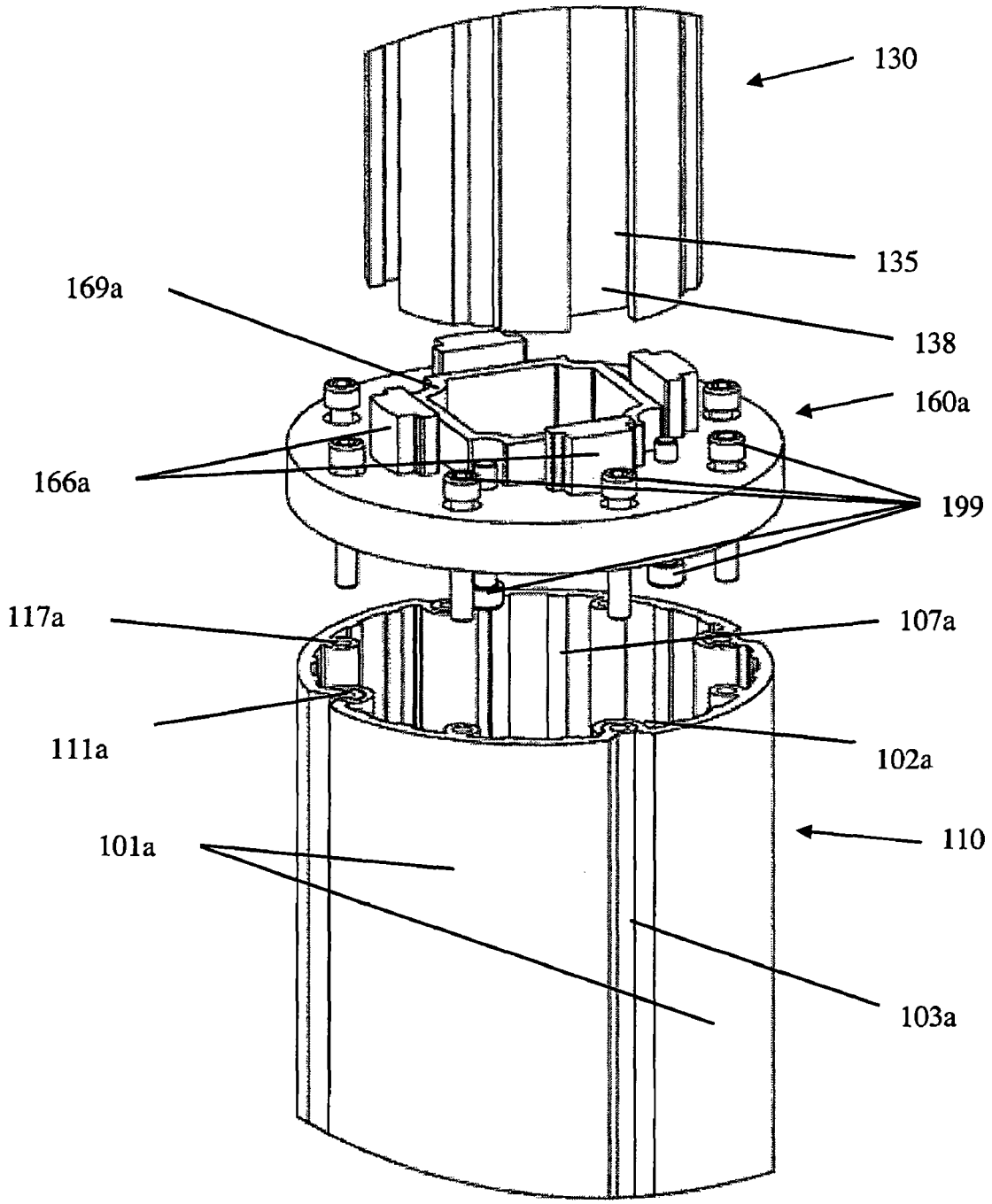
FIG. 6 illustrate joining of the upper pole section (130) and lower pole section (110) through the fastening plate (160*a*) shown in FIG. 5.
Figure 7:
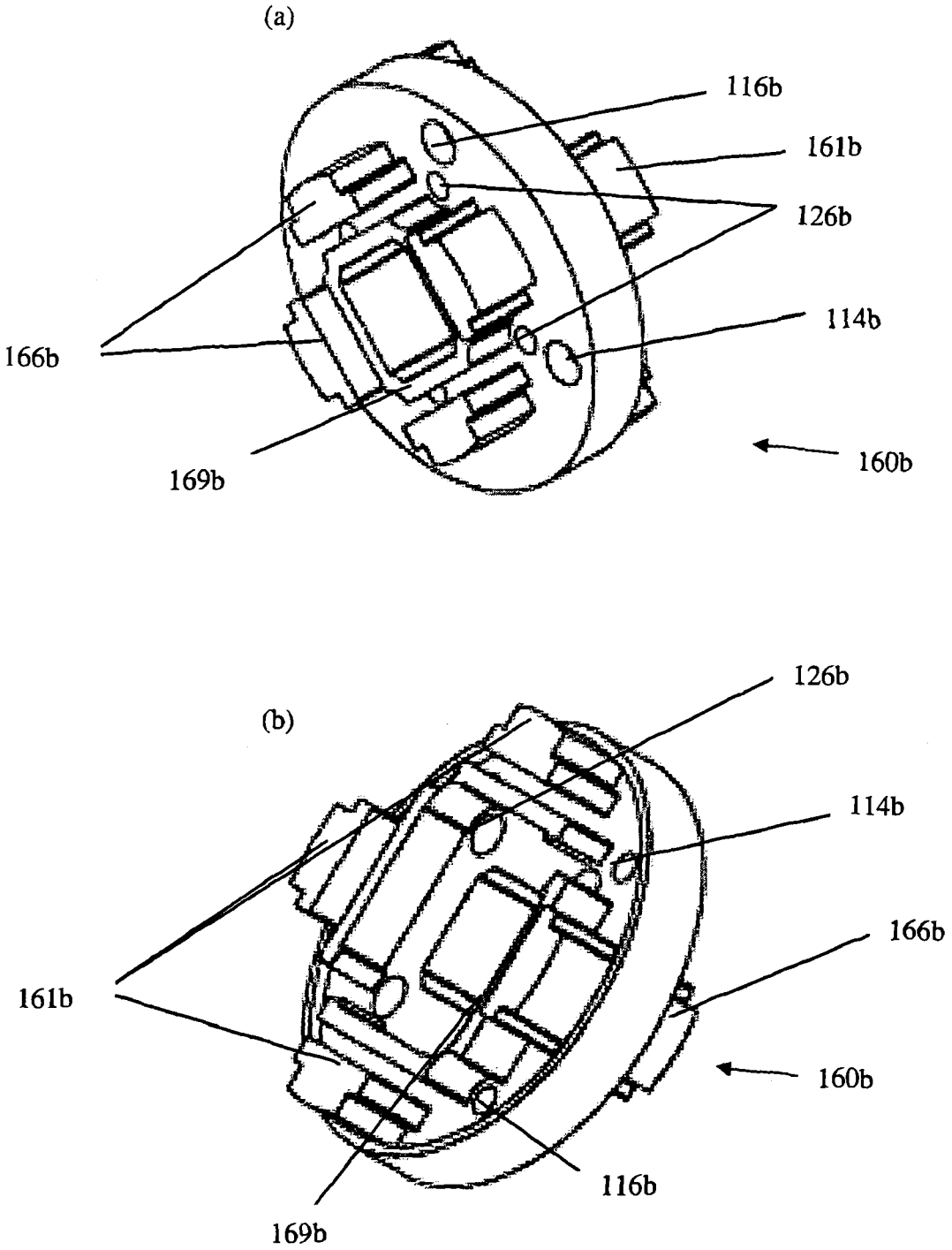
FIG. 7 shows perspective (a) front and (b) back view of another embodiment of the fastening plate (160*b*) for joining the lower pole section (110) and upper pole (130) section.

Turning now to FIGS. 5 and 7, two embodiments of the fastening plate (160*a*) of the disclosed invention are presented. The fastening plate (160*a*), in the embodiment of FIG. 5, has the first through holes (116*a*) fabricated adjacent to the outer rim of the fastening plate (160*a*). Preferably, each first through hole (116*a*) is equally separated from one another in relative to the center axis of the fastening plate (160*a*). Further, the second through holes (114*a*) are positioned in between two contiguous first through holes (116*a*) and equally spaced apart in relative to the center axis as well. Preferably, distances of the first (116*a*) and second through holes (114*a*) in relative to the center axis are same. More preferably, the first (116*a*) and second through holes (114*a*) collectively form a circular formation on the fastening plate (160*a*) and the through hole (114*a* and 116*a*) are equally separated in the circular formation. While the third through holes (126*a*) are located closer to the center axis of the fastening plate (160*a*) surrounded by the first (116*a*) and second through holes (114*a*). The third through holes (126*a*) are uniformly positioned around the center axis. Besides having the through holes and respective groove to facilitate the engagement of the fastening plate (160*a*) to the upper pole section (130), the fastening plate (160*a*) also possesses protruding configuration or profile to fit into compatible configuration on the upper pole section (130). Specifically, the fastening plate (160*a*) has a second male protruding configuration (166*a*) at the top and the upper pole section (130) has a second female receptive configuration (138) that mating of the second male protruding configuration (166*a*) and second female receptive configuration (138) interlock the upper pole section (130) to the fastening plate (160*a*). As indicated in FIG. 5, the top of the fastening plate (160*a*) has inverted-T shaped protrusion to fit into the track (135) fabricated on the exterior surface (139) of the upper pole section (130). Thus, the disclosed invention utilizes the track (135) for fixture attachment as the female receptive configuration (138) as well to enhance the engagement of the fastening plate (160*a*) and the upper pole. In further embodiment, the fastening plate (160*a*) may additionally carry another supplementary interlocking profile (169*a*) such as an uprising square located around the center portion of the fastening plate (160*a*) presented in FIG. 5. The square protrusion is configured to be slotted into the hollow enclosed inside the upper pole section (130) thus holding the upper pole section (130) thereof. The external side surface of the uprising protrusion may abut onto the interior side surface of the upper pole section (130) upon establishment of the engagement. Further, the four corners of the supplementary interlocking profile (169*a*) are inwardly curved for positioning of the third through holes (126*a*). Engagement of the lower pole section (110) and upper pole section (130) using fastening plate (160*a*) of this embodiment is presented in FIG. 6.

FIG. 7 shows another embodiment of the fastening plate (160*b*) used in the disclosed invention. The fastening plate (160*b*) of this embodiment is equipped with interlocking configuration or profile to use the tracks (105 or 135) for fixture available on both upper pole section (130) and lower pole section (110*b*) for the joining Particularly, both bottom and top surfaces of fastening plate (160*b*) in this embodiment are fabricated with the first (161*b*) and second male protruding (166*a*) configuration, the inverted-T shaped protrusions, being sized to fit into the track (105 and/or 135) fabricated on the exterior surface (109) of the lower pole section (110) and upper pole section (130) respectively. The inverted-T shaped protrusions at bottom are positioned nearer to the rim of the fastening plate (160*b*), while those at the top are located closer to the center axis of the fastening plate (160*b*). These male protruding configurations are slid into the respective tracks found on the pole section to facilitate the interlocking and fastening. Specifically, the fastening plate (160*b*) has a first male protruding configuration (161*b*) at the bottom and the lower pole section (110) has a first female receptive configuration (128) that mating of the first male protruding configuration (161*b*) and first female receptive configuration (128) interlocks the lower pole section (110) to the fastening plate (160*b*). The track (105) at the lower pole section (110) is preferably the first female receptive configuration (128). Likewise, the fastening plate (16012) has a second male protruding configuration (166*b*) at the top and the upper pole section (130) has a second female receptive configuration (138) that mating of the second male protruding configuration (166*b*) and second female receptive configuration (138) interlock the upper pole section (130) to the fastening plate (160*b*). More preferably, the track (135) at the upper pole section (130) is the second female receptive configuration (138). Further, the distances of the first (116*b*) and second through holes (114*b*) in relative to the center axis on the fastening plate (160*b*) are the same. The third through holes (126*b*) are located closer to the center axis of the fastening plate (160*b*) surrounded by the first (116*b*) and second through holes (114*b*). The third through holes (126*b*) are uniformly positioned around the center axis. The fastening plate (160*b*) of this embodiment bears as well another supplementary interlocking profile (169*b*) at both top and bottom. Preferably, the supplementary interlocking profile (169*b*) are substantially square protrusion projecting out from the top and bottom at a direction perpendicular to the planar of the top and the bottom. These protrusion are located around the center portion of the fastening plate (160*b*) presented in FIG. 7. The square protrusion is configured to be slotted into the hollow enclosed inside the pole section thus holding the pole section thereof. The four corners of the supplementary interlocking profile (169*b*) at the top are inwardly curved for positioning of the third through holes (126*b*), while the supplementary interlocking profile (169*b*) at the bottom has two being inwardly curved and two being removed for positioning of the third through holes (126*b*). Engagement of the lower pole section (110*b*) and upper pole (130) section using fastening plate (160*b*) of this embodiment is presented in FIG. 8.

Figure 10:
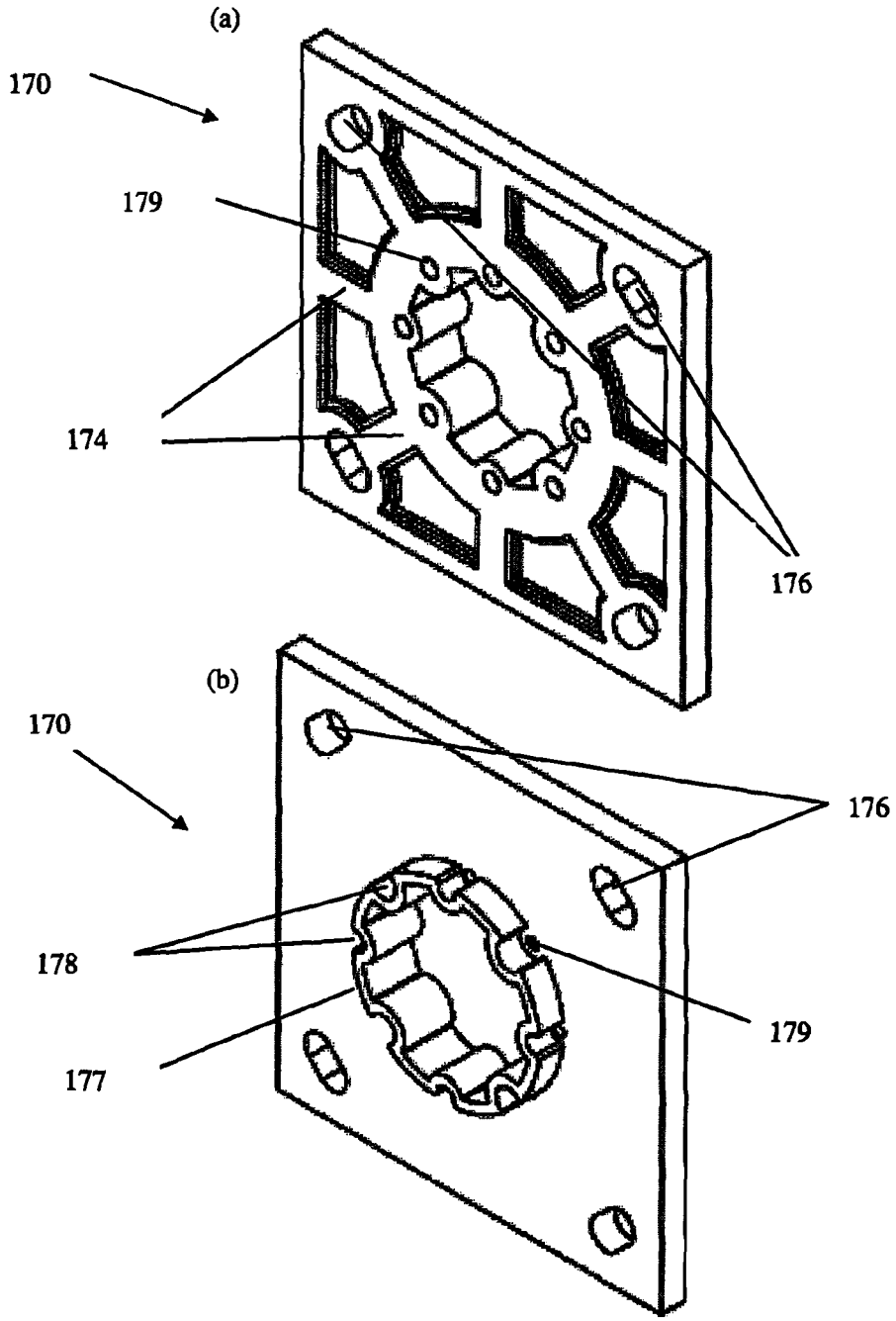
FIG. 10 shows one embodiment of the base plate.
Figure 11:
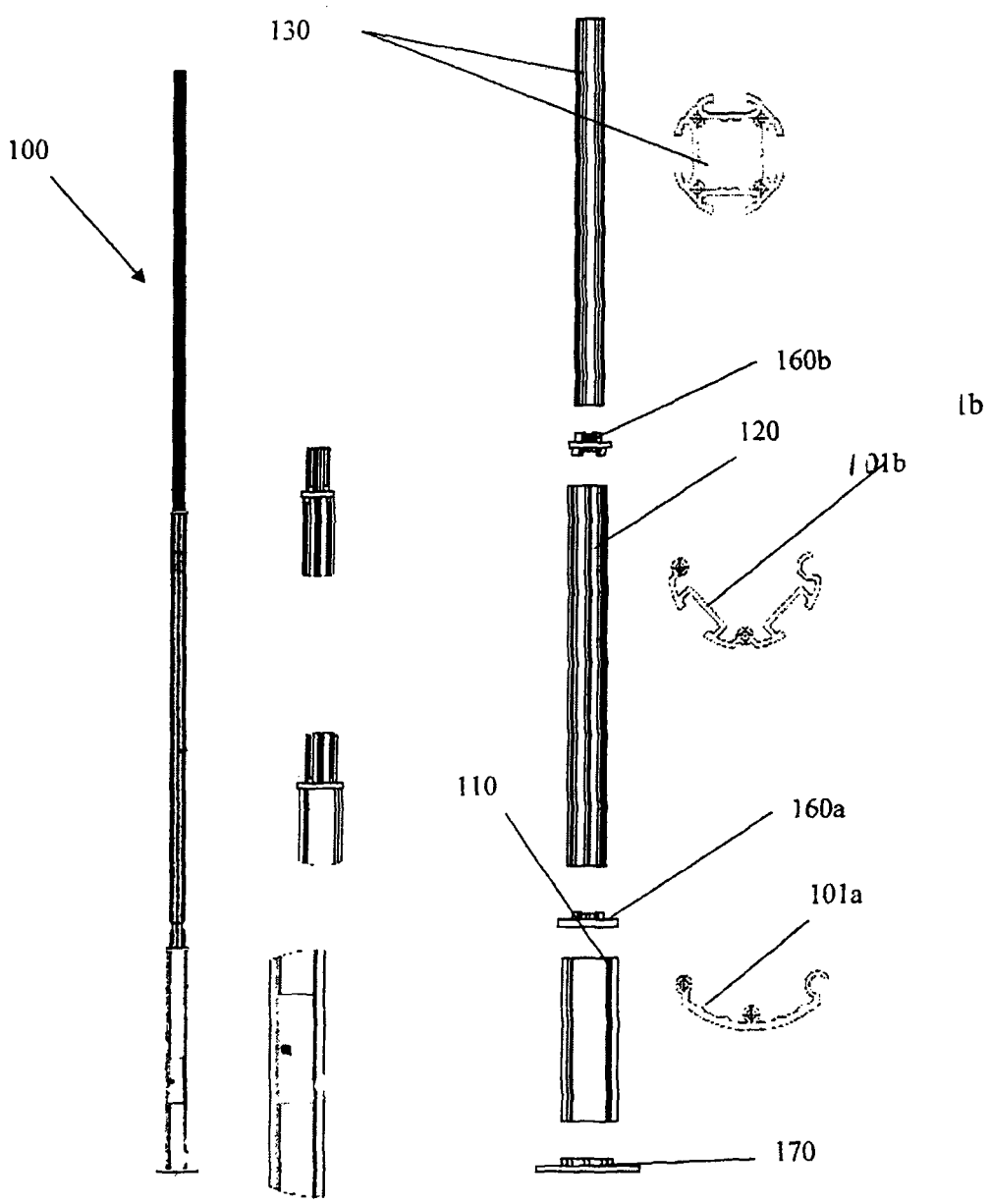
FIG. 11 shows one embodiment of the utility pole (100) disclosed in the present invention.

One of the embodiments of the present invention further comprises a base plate (170), for anchoring onto the ground, having a horizontally upraised projection (177) of circular formation located substantially at the center of the base plate that side surface of the projection has a plurality of indentation (178) to neatly fit in part of the retaining track (102*a*) of the metal pieces (101*a*) of another end of the lower pole section (110). One embodiment of the base plate (170) is illustrated in FIG. 10. Basically, the base plate (170) is the mounting anchored to the ground for subsequent erection of the disclosed utility pole (100). It fixes the free end of the lower pole section (110) to the ground. As presented in FIG. 10, a plurality of through holes, locking apertures (179), are fabricated on the base plate (170) that the through holes are located at a position matching the bottom opening (113) of the first (111) and second locking groove (117). Thus, bolt (199) and the like can be inserted into through holes and access into the first (111) and/or second locking groove (117) to lock the lower pole section (110) onto the base plate (170) upon slotting the lower pole section (110) into the upraised projection (177). Specifically, the disclosed invention further comprises a base plate (170), for anchoring onto the ground, having a locking aperture (179) corresponded to the first bottom opening (113) that plugging a bolt (199) via the first bottom opening (113) into the first locking groove (111) and the locking aperture (179) interlocks the metal piece (101) and the base plate (170). Apart from that, anchoring points (176) are provided on the base plate (170), preferably at its four corners, to offer way for securing the base plate (170) onto the ground. The bottom of the base plate (170) may carry protruding ribs (174) to improve mechanical integrity of the base plate.

Pursuant to another embodiment, the disclosed invention is a utility pole (100) comprising a lower pole section (110); an middle pole section (120); and a primary fastening plate (160*a*) mounted at one end of the lower pole section (110) and middle pole (120) section to join both sections together; wherein at least one of the pole section is composed of a plurality of identical elongate metal pieces (101*a* or 101*b*) that each carries a retaining track (102*a* or 102*b*) and a shaft (103*a* or 103*b*) at its respective long edges characterized in that the pole section (110 or 120) is assembled through arranging the metal pieces (101*a* or 101*b*) in a side-by-side fashion at the long edges to form a substantial tubular formation and two contiguous arranged metal pieces (101*a* or 101*b*) are interlocked by engaging the shaft (103*a* or 103*b*) of one metal piece (101*a* or 101*b*) to the retaining track (102*a* or 102*b*) of the adjacent metal piece. Preferably, metal pieces (101*a*) of the embodiment shown in FIGS. 1 and 2 are used in assembling the lower pole section (110). In more specific, the metal piece (101*a*) is substantially flat piece besides being outwardly curved at the longitudinal axis to allow tubular formation of the lower pole section (110) upon assembly of the identical metal pieces (101*a*). Longitudinal ribs (107*a*) are fabricated at the inner (108*a*) and/or exterior surface (109*a*) of the metal piece (101*a*) in one embodiment. The two long edges at the side of the metal piece (101*a*) of the lower pole section (110), respectively, have the shaft (103*a*) and the retaining track (102*a*). The shaft (103*a*) in the preferred embodiment is a rod-like structure attached to one edge of the metal piece (101*a*) that the shaft (103*a*) has a diameter greater than the average thickness of the metal piece. Further, the retaining track (102*a*) is a trough-like structure with C-shaped cross-section as shown in FIG. 2*a* that a longitudinal groove is contained within the retaining track (102*a*) with a corresponding longitudinal side opening (106*a*). Shaft (103*a*) of an adjacent metal piece can be slid into the groove within the retaining track (102*a*) via the side opening (106*a*) and the groove adapts to accommodate shaft (103*a*). Particularly, the side opening (106*a*) has a width smaller than the diameter of the shaft (103*a*) to avoid disengagement of the shaft (103*a*) from the side opening (106*a*) once the metal pieces (101*a*) are interlocked. The retaining track (102*a*) and the shaft (103*a*) of the metal piece (101*a*), in the embodiment of FIGS. 1 and 2, are substantially in an orthogonal position to one another in relative to the center axis of the lower pole section (110).

To create the middle pole section (120), the metal piece (101*a*) described above can be used though. Yet, the more preferred embodiment of the metal piece (101*b*) employed for construction of middle pole section is shown in FIGS. 3 and 4. In contrast to the above embodiment, the metal piece (101*b*) of this embodiment has the shaft (103*b*) and the retaining track (102*b*) together with the center axis of the middle pole section (120) collectively form a straight line or there exists 180° between the shaft (103*b*) and the retaining track (102*b*) in relative to the center axis of the pole section. The middle pole section (120) can be assembled by joining only two identical metal pieces (101*b*) of such embodiment together. It is important to be noted that the assembled middle pole section (120) has an averaged diameter smaller than the assembled lower pole section (110) to enhance stability of the produced utility pole (100). In the like manner, the metal piece (101*b*) has the retaining track (102*b*) defining a groove with side opening (106*b*) and fabricated longitudinally extending ribs (107*b*). Preferably, the exterior surface (109*b*) of the metal pieces (101*b*) is fabricated with track (105) for releasably attachment of one or more fixture. It allows the fixture to mount on the middle pole section (120) to carry out the desired function. Specifically, track (105) carries a profile or groove in the cross-sectional inverted T-shape extending from one short edge to another short edge of the metal piece (101*b*). The inverted T-shaped groove is an indented area with the wider portion of the inverted T-shaped groove resides closer to the center axis of the middle pole section (120) and serves to receive part of the fixture with a compatible profile to slide in from the top or bottom of the metal piece (101*b*). The narrow portion is formed by having a pair of opposite protrusion slightly raised from the upper fringe of the indented area to provide an opening allowing the rest of the fixture extended out. Moreover, the narrow portion of smaller size also prevents disengagement of the fixture thereof apart from the top or bottom of the metal piece (101*b*).

More preferably, at least one of the metal piece (101*a*) at the lower pole section defining a longitudinal second locking groove (117*a*) accessible by way of a second top (118*a*) and bottom openings (119*a*) and the primary fastening plate (160*a*) possesses a corresponding second through hole (114*a*) that plugging a bolt (199) via the second top opening (118*a*) into the second locking groove (117*a*) and the second through hole (118*a*) interlocks the metal piece (101*a*) and the primary fastening plate (160*a*).

FIG. 5 shows one embodiment of the primary fastening plate (160*a*) to join the lower pole section (110) and middle pole (120) section. More specifically, the primary fastening plate (160*a*) has the first through holes (116*a*) fabricated adjacent to the outer rim of the fastening plate (160*a*). Preferably, each first through hole (116*a*) is equally separated from one another in relative to the center axis of the fastening plate (160*a*). Further, the second through holes (114*a*) are positioned in between two contiguous first through holes (116*a*) and equally spaced apart in relative to the center axis as well. Preferably, distances of the first (116*a*) and second through holes (114*a*) in relative to the center axis are same. More preferably, the first (116*a*) and second through holes (114*a*) collectively form a circular formation, on the primary fastening plate (160*a*) and the through hole (114*a* and 116*a*) are equally separated in the circular formation. While the third through holes (126*a*) are located closer to the center axis of the fastening plate (160*a*) surrounded by the first (116*a*) and second through holes (114*a*). The third through holes (126*a*) are uniformly positioned around the center axis. Besides having the through holes and respective groove to facilitate the engagement of the fastening plate (160*a*) to the middle pole section (120), the primary fastening plate (160*a*) also possesses protruding configuration or profile to fit into compatible configuration on the middle pole section (120). Specifically, the primary fastening plate (160*a*) has a second male protruding configuration (166*a*) at the top and the middle pole section (120) has a second female receptive configuration (138) that mating of the second male protruding configuration (166*a*) and second female receptive configuration (138) interlock the middle pole section (120) to the primary fastening plate (160*a*). The top of the primary fastening plate (160*a*) has inverted-T shaped protrusion to fit into the track (105) fabricated on the exterior surface (109*b*) of the middle pole section (120). Thus, the disclosed invention utilizes the track (105) for fixture attachment as the second female receptive configuration (138) as well to enhance the engagement of the primary fastening plate (160*a*) and the middle pole (120). In further embodiment, the primary fastening plate (160*a*) may additionally carry another supplementary interlocking profile (169*a*) such as an uprising square located around the center portion of the primary fastening plate (160*a*) presented in FIG. 5. The square protrusion is configured to be slotted into the hollow enclosed inside the middle pole section (120) thus holding the middle pole section (120) thereof. The external side surface of the uprising protrusion may abut onto the interior side surface of the middle pole section (120) upon establishment of the engagement. Further, the four corners of the supplementary interlocking profile (169*a*) are inwardly curved for positioning of the third through holes (126*a*). Engagement of the lower pole section (110) and middle pole section (120) using the primary fastening plate (160*a*) of this embodiment is presented in FIG. 6.

Still, another preferred embodiment of the disclosed invention includes an upper pole section (130) joined to another end of the middle pole section through a secondary fastening plate (160*b*). Preferably, the upper pole section (130) has at least one longitudinal third locking groove (121) accessible by way of a third bottom opening (123) and the fastening plate (160*b*) possesses corresponding third through hole (126*b*) that plugging a bolt (199) via the third bottom opening (123) into the third locking groove (121) and the third through hole (126*b*) interlocks the upper pole section (130) and the secondary fastening plate (160*b*) as shown in FIG. 9. The FIG. 9 further illustrates that there are four different third locking grooves (121) located at each individual corner of the square tube. The joining of the upper pole section (130) and middle pole (120) section requires the secondary fastening plate (160*b*) to be used in conjunction. FIG. 7 shows one embodiment of the secondary fastening plate (160*b*). The secondary fastening plate (160*b*) is equipped with interlocking configuration or profile to use the tracks for fixture available on both upper pole section (130) and middle pole (120) section for the joining. Particularly, both bottom and top surfaces of secondary fastening plate (160*b*) prepared in this embodiment are fabricated with the first (161*b*) and second male protruding configuration (166*b*), the inverted-T shaped protrusions, being sized to fit into the track (105 and 135) fabricated on the exterior surface (109*b* and/or 139) of the middle pole section (120) and upper pole section (130) respectively. The inverted-T shaped protrusions at bottom are positioned nearer to the rim of the secondary fastening plate (160*b*), while those at the top are located closer to the center axis of the secondary fastening plate (160*a*). These male protruding configurations (161*b* and 166*b*) are slid into the respective tracks (135 and 105) found on the upper pole section (130) and middle pole (120) section to facilitate the interlocking and fastening. Specifically, the secondary fastening plate (160*b*) has a first male protruding configuration (161*b*) at the bottom and the middle pole section has a first female receptive configuration (128) that mating of the first male protruding configuration (161*b*) and first female receptive configuration (128) interlock the middle pole section (120) to the secondary fastening plate (160*b*). The track at the middle pole section is preferably the first female receptive configuration (128). In the same manner, the secondary fastening plate (1602) has a second male protruding configuration (166*b*) at the top and the upper pole section (130) has a second female receptive configuration (138) that mating of the second male protruding configuration (166*b*) and second female receptive configuration (138) interlock the upper pole section (130) to the secondary fastening plate (160*b*). More preferably, the track (135) at the upper pole section (130) is the second female receptive configuration (138). Further, the distances of the first (116*b*) and second through holes (114*b*) in relative to the center axis on the secondary fastening plate (160*b*) are the same. The third through holes (126*b*) are located closer to the center axis of the fastening plate (1602) surrounded by the first and second through holes. The third through holes (126*b*) are uniformly positioned around the center axis. The secondary fastening plate (160*b*) bears as well another supplementary interlocking profile (169*b*) at both top and bottom. Preferably, the supplementary interlocking profile (169*b*) are substantially square protrusion projecting out from the top and bottom at a direction perpendicular to the planar of the top and the bottom. These protrusion are located around the center portion of the secondary fastening plate (160*b*) presented in FIG. 7. The square protrusion is configured to be slotted into the hollow enclosed inside the pole section thus holding the pole section thereof. Engagement of the middle pole section (120) and upper pole section (130) using the secondary fastening plate (160*b*) of this embodiment is presented in FIG. 8.

The present invention also discloses an article of elongate metal piece (101*a*) comprising a retaining track (102*a*) and a shaft (103*a*) at its respective long edges, wherein multiple pieces (101*a*) of the identical articles are arranged in a side-by-side fashion to assemble a pole section with two contiguous arranged metal pieces (101*a*) interlocked by engaging the shaft (103*a*) of one metal piece to the retaining track (102*a*) of another adjacent metal piece. One embodiment of the article (101*a*), preferably, carries a rather smooth exterior surface (109) while the inner surface is fabricated with a plurality of longitudinally extending ribs (107). The longitudinal ribs (107) are fabricated at the exterior surface (109) or both surface in another embodiment. Like in the foregoing, the two long edges at the side of the metal piece, respectively, have the shaft (103*a*) and the retaining track (102*a*). The shaft (103*a*)

in the preferred embodiment is a rod-like structure attached to one edge of the metal piece (101*a*) that the shaft (103*a*) has a diameter greater than the average thickness of the metal piece. Shown in FIGS. 1 and 2, the shaft (103*a*) is a extending continuously as a single structure. The shaft (103*a*) is fabricated in the form of multiple parallel shorter sections with a gap spaced in between two contiguous sections in another embodiment. Particularly, the retaining track (102*a*) is a trough-like structure with C-shaped cross-section as shown in FIG. 2*a* that a longitudinal groove is contained within the retaining track (102*a*) with a corresponding longitudinal side opening (106). Shaft (103*a*) of an adjacent metal piece (101*a*) can be slid into the groove within the retaining track (102*a*) via the side opening and the groove adapts to accommodate shaft. The side opening has a width smaller than the diameter of the shaft (103*a*) to avoid disengagement of the shaft (103*a*) from the side opening (106) once the metal pieces (101*a*) are interlocked. Another embodiment of the article is shown in FIGS. 3 and 4. In contrast to the embodiment of FIGS. 1 and 2, the metal piece (101*a*) of this embodiment has the shaft (103*a*) and the retaining track (102*a*) together with the center axis of the pole section collectively form a straight line or there exists 180° between the shaft (103*a*) and the retaining track (102*a*) in relative to the center axis of the pole section. More preferably, the shafts (103*a*) define an internal first locking groove (111) accessible by way of a first top (112) and a first bottom openings (113) that a fastening plate (160*a*) having corresponding first through hole (116) is interlockable to the metal piece (101*a*) by plugging a bolt via the first top opening (112) into the first locking groove (111).

Figure 12:
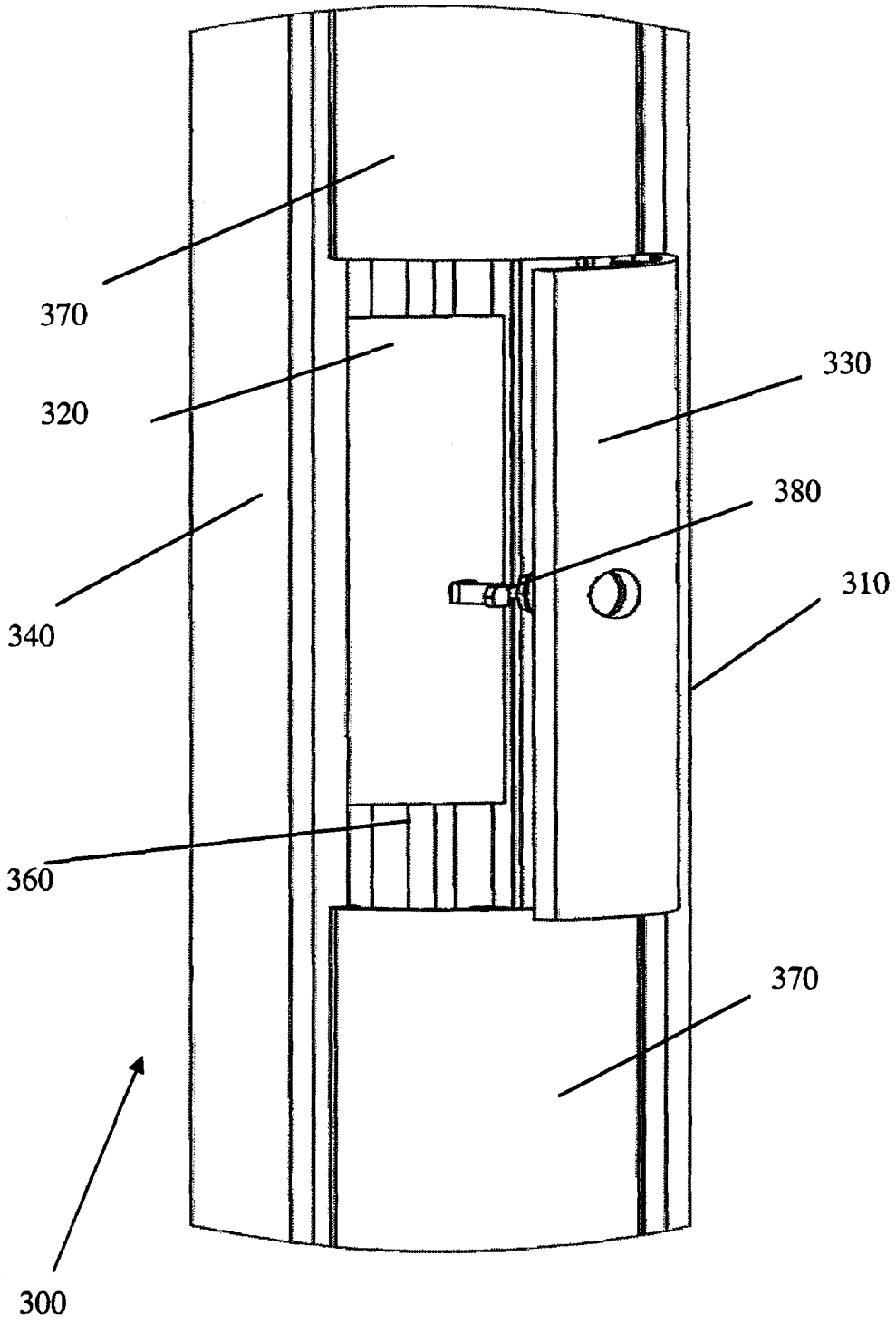
FIG. 12 shows one embodiment of the reclosable door on the pole to provide access to the service chamber.
Figure 13:
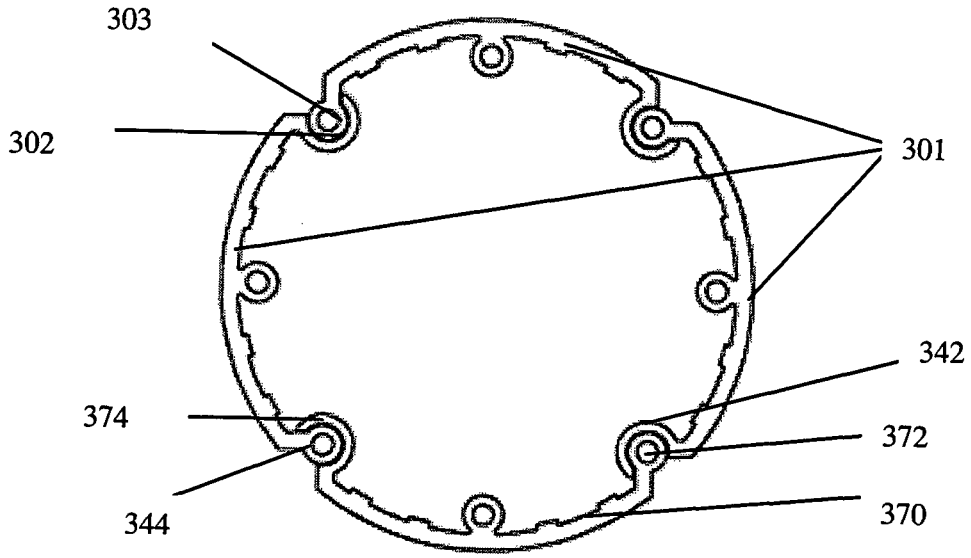
FIG. 13 shows the cross-sectional view of the pole section together with the side door free of one interlocking profile.
Figure 14:
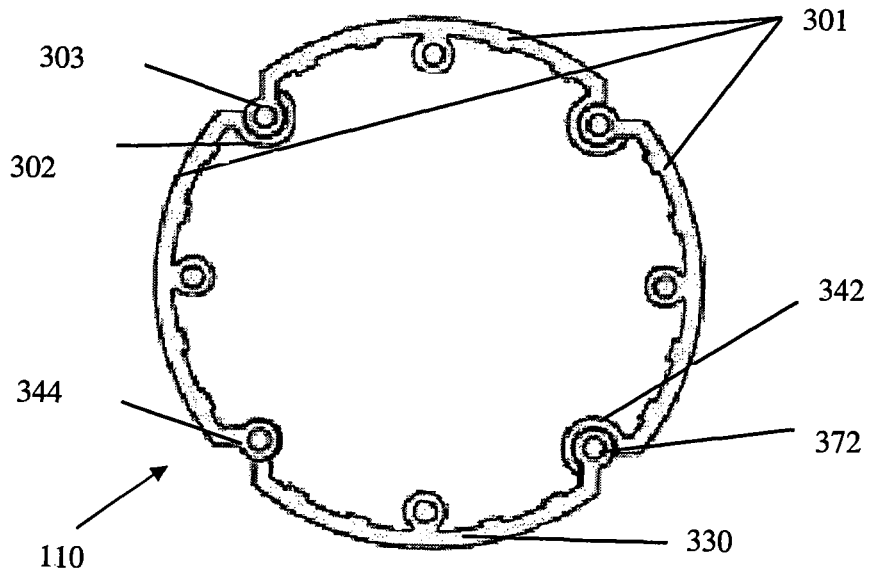
FIG. 14 shows the cross-sectional view of the pole section together with the elongate part with both third and fourth interlocking profiles.

In another embodiment, the present invention discloses a utility pole (300), as shown in FIG. 12, comprising a pole section (310) having a service chamber (320) defined within the pole section (110) accessible by way of a reclosable side door (330) fabricated on the pole section (310); characterized in that the pole section (310) comprises an elongate frame structure (340), which is outwardly curved at the horizontal axis, carrying a first (342) and a second interlocking profiles (344) at its respective vertical edges with a gap (360) presented in between the vertical edges; and a plurality elongate parts (370) having a third (372) and a fourth interlocking profiles (374), at its respective vertical edges, which allow the elongate parts (370) to slidably and stackably engage onto the first (342) and second interlocking profiles (344) of the frame structure (340) to substantially shield the gap (360), wherein one of the elongate parts serving as the side door (330) is free of one of the interlocking profiles to be pivotally moveable in relative to the frame structure (340) in between an open position to provide access to the service chamber (320) and a close position to substantially shield the gap (360). Owing to the slide-in or slot-in engagement of the elongate part (370) functioning as the side door (330) onto the frame structure (340), the hinge facilitating movement of the side door (330) is substantially hidden from the exterior environment of the pole section (310). Consequently, it is unlikely that one is capable of gaining access to the component stored within the chamber (320) by damaging the hinge compared to those conventional poles bearing side door having the hinge welded on the exterior surface of the pole section. Utility pole (300) with side door of current design possesses significant improvement in securing the stored component from being sabotaged.

In one embodiment, the first (342) and second interlocking profiles (344) can be identical on the frame structure (340). For example, the first (342) and second interlocking profiles (344) can be both in the form of retaining track or shaft, as illustrated in FIGS. 1 to 4, as long the third (372) and fourth interlocking profiles (374) carried on the elongate parts (370) are corresponding shaft or retaining track realizing the slide-in interlocking mechanism. More preferably, the elongate part (370) functioning as the side door (330) is sandwiched in between a top (375) and a bottom (376) elongate part as illustrated in FIG. 12. It is important to be noted that presence of the top (375) and bottom elongate parts (376) mainly aim to assist in positioning the side door (330) on the pole section (310) at a location offering sufficient convenience to access the enclosed chamber (320) while shielding the rest of the gap (360). The top (375) and bottom elongate parts (376) may be variable in length for better positioning the side door (330). Further, the number of top (375) and/or bottom elongate parts (376) can be increased or reduced for other embodiments.

In one embodiment, the frame structure (340) is a single piece construct, which has a substantial cross-sectional C-shaped formation at the horizontal planar, and the first (342) as well as second interlocking profiles (344) located at its respective vertical edges or ends. Yet, in the more preferred embodiment, the frame structure (340) of the pole section (310) is composed of a plurality of identical elongate metal pieces (301), each carries a retaining track (302) and a shaft (303) at its respective long edges, and the frame structure is assembled through arranging the metal pieces (301) in a side-by-side fashion at the long edges to form a substantial tubular formation with two contiguous arranged metal pieces (101*a*) being interlocked by slidably engaging the shaft (303) of one metal piece (301) to the retaining track (302) of the adjacent metal piece (301) that the retaining track (302) and the shaft (303) free from interlocking onto other metal pieces (101*a*) form the first (342) and second interlocking profiles (344) respectively at the vertical edges of the frame structure (340). This embodiment further improves portability and on-site workability of the disclosed invention combining the various foregoing embodiments.

Further, a locking means (380) may be mounted on the pole section (310) to secure the side door (330) onto the frame structure (340). The locking means (380) can be derived of various known locking mechanism known in the art such as simple rim lock, warded lock, lever tumbler lock and the like. The locking means (380) is operated through a match key to lock and unlock the side door (330) onto the frame structure (340). Though it is preferred to have the locking means (380) resided within or mounted on the side door (330), the locking means (380) may be fixed onto the frame structure (340) and operatively interacted with side door (330).

Still, in one embodiment, the elongate part (370) is a single piece. Preferably, the disclosed invention is a utility pole (300) comprising a pole section (310) having a service chamber (320) defined within the lower pole section (310) accessible by way of a reclosable side door (330) fabricated on the lower pole section (310); characterized in that the pole section (310) comprises an elongate frame structure (340), which is outwardly curved at the horizontal axis, carrying a first interlocking profile (342) at one vertical edge with a gap (360) presented in between the vertical edges; and an elongate parts (370) having a third interlocking profile (372), at one vertical edges, which allow the elongate part (370) to slidably engage onto the first interlocking profile (342) of the frame structure (340) to substantially shield the gap (360), wherein the elongate parts (370) serving as the side door (330) to be pivotally moveable in relative to the frame structure (340) in between an open position to provide access to the service chamber (320) and a close position to substantially shield the gap (360). In the like manner, the single-piece elongate part (370) only requires a slide-in interlocking profile to facilitate the pivot engagement thereby realizing the hinged movement of the side door (330). Further, the described embodiment also has a locking means (380) mounted on the pole section (310) to secure the side door (330) onto the frame structure (340). Similarly, the frame structure (340) is composed of a plurality of identical elongate metal pieces (301), each carries a retaining track (302) and a shaft (303) at its respective long edges, and the frame structure is assembled through arranging the metal pieces (301) in a side-by-side fashion at the long edges to form a substantial tubular formation with two contiguous arranged metal pieces (301) being interlocked by slidably engaging the shaft (303) of one metal piece to the retaining track (302) of the adjacent metal piece that at least one of the retaining track (302) or the shaft (303) free from interlocking onto other metal pieces (301) form the first interlocking profile (342) at the vertical edges of the frame structure (340).

It is to be understood that the present invention may be embodied in other specific forms and is not limited to the sole embodiment described above. However modification and equivalents of the disclosed concepts such as those which readily occur to one skilled in the art are intended to be included within the scope of the claims which are appended thereto.

The invention claimed is:

1. A utility pole, comprising:

a lower pole section;

an upper pole section; and a fastening plate mounted at one end of the lower and upper pole sections to join both sections together;

wherein the lower pole section is composed of a plurality of identical elongate metal pieces wherein each piece includes a retaining track and a shaft at a long edge thereof, wherein the lower pole section is assembled through arranging the pieces in a side-by-side fashion at the long edges thereof to form a substantially tubular formation, wherein the pieces are interlocked together by engaging the shaft of one of the pieces to the retaining track of an adjacent piece;

wherein the shaft defines an internal first locking groove in communication with first top and bottom openings and the fastening plate possesses corresponding first through hole that, when engaged by a bolt via the first top opening into the first locking groove and the first through hole, interlocks the piece and the fastening plate.

2. The utility pole of claim 1, wherein the piece defines a longitudinal second locking groove in communication with second top and bottom openings and the fastening plate possesses corresponding second through hole that, when engaged by a bolt via the second top opening into the second locking groove and the second through hole, interlocks the piece and the fastening plate.

3. The utility pole of claim 2, wherein the upper pole section has at least one longitudinal third locking groove in communication with third top and bottom openings and the fastening plate possesses corresponding third through hole that, when engaged by a bolt via the third bottom opening into the third locking groove and the third through hole, interlocks the upper pole section and the fastening plate.

4. The utility pole of claim 1, wherein the fastening plate has a first male protruding configuration at a bottom portion and the lower pole section has a first female receptive configuration that mating of the first male protruding configuration and first female receptive configuration interlock the lower pole section to the fastening plate.

5. The utility pole of claim 1, wherein the fastening plate has a second male protruding configuration at a top portion and the upper pole section has a second female receptive configuration that mating of the second male protruding configuration and second female receptive configuration interlock the upper pole section to the fastening plate.

6. The utility pole of claim 1, wherein the lower pole section has an exterior surface fabricated with one or more track for releasably attachment of one or more fixture.

7. The utility pole of claim 4, wherein the lower pole section has an exterior surface fabricated with one or more track for releasably attachment of one or more fixture and the track is the first female receptive configuration.

8. The utility pole of claim 1, wherein the upper pole section has an exterior surface fabricated with one or more track for releasably attachment of one or more fixture.

9. The utility pole of claim 5, wherein the upper pole section has an exterior surface fabricated with one or more tracks for releasably attachment of one or more fixture and the track is the second female receptive configuration.

10. The utility pole of claim 1, further comprising a base plate, for anchoring onto the ground, having a horizontally upraised projection of circular formation located substantially at a center of the base plate, wherein a side surface of the projection has a plurality of indentations to fit in part of the retaining track of one of the pieces of another end of the lower pole section.

11. The utility pole of claim 1, further comprising a base plate, for anchoring onto the ground, having a locking aperture corresponded to the first bottom opening that when engaged by a bolt via the first bottom opening into the first passage and the locking aperture interlocks the metal piece and the base plate.

12. A utility pole, comprising:

a lower pole section;

an middle pole section; and a primary fastening plate mounted at one end of the lower and middle pole sections to join both sections together;

wherein the lower pole section is composed of a plurality of identical elongate metal pieces wherein each piece includes a retaining track and a shaft at a long edge thereof, wherein the lower pole section is assembled through arranging the pieces in a side-by-side fashion at the long edges thereof to form a substantially tubular formation, wherein the pieces are interlocked together by engaging the shaft of one of the pieces to the retaining track of an adjacent piece;

wherein the shaft defines an internal first locking groove in communication with first top and bottom openings and the primary fastening plate possesses corresponding first through hole that, when engaged by a bolt via the first top opening into the first locking groove and the first through hole, interlocks the piece and the primary fastening plate.

13. The utility pole of claim 12, further comprising an upper pole section joined to another end of the middle pole section through a secondary fastening plate.

14. The utility pole of claim 12, wherein at least one of the pieces at the lower pole section defines a longitudinal second locking groove in communication with second top and bottom openings and the primary fastening plate possesses a corresponding second through hole that, when engaged by a bolt via the second top opening into the second locking groove and the second through hole, interlocks the metal piece and the primary fastening plate.

15. The utility pole of claim 13, at least one of the pieces at the lower pole section defines a longitudinal second locking groove in communication with second top and bottom openings and the primary fastening plate possesses a corresponding second through hole that, when engaged by a bolt via the second top opening into the second locking groove and the second through hole, interlocks the metal piece and the primary fastening plate.

16. The utility pole of claim 13, wherein the secondary fastening plate has a first male protruding configuration at a bottom portion and the middle pole section has a first female receptive configuration that mating of the first male protruding configuration and first female receptive configuration interlock the middle pole section to the secondary fastening plate.

17. The utility pole of claim 16, wherein the secondary fastening plate has a second male protruding configuration at a top portion and the upper pole section has a second female receptive configuration that mating of the second male protruding configuration and second female receptive configuration interlock the upper pole section to the secondary fastening plate.

18. The utility pole of claim 16, wherein the middle pole section has an exterior surface fabricated with one or more tracks for releasable attachment of one or more fixtures, wherein the tracks include the first female receptive configuration.

19. The utility pole of claim 17, wherein the upper pole section has an exterior surface fabricated with one or more tracks for releasable attachment of one or more fixtures, wherein the tracks include the second female receptive configuration.

* * * * *